United States Patent [19]

Hemmeter

[11] Patent Number: 4,620,702

[45] Date of Patent: Nov. 4, 1986

[54] MODIFIED GARDEN SWING WITH STABILIZER

[76] Inventor: George T. Hemmeter, 4125 Black Point Rd., Honolulu, Hi. 90816

[21] Appl. No.: 746,134

[22] Filed: Jun. 18, 1985

[51] Int. Cl.[4] ..... A47B 39/00

[52] U.S. Cl. ..... 272/85; 297/245; 297/273; 297/157

[58] Field of Search ..... 272/89, 90, 91, 92, 272/88, 87, 86, 85; 248/139, 140, 370, 163.2; 297/244, 245, 246, 247, 273, 276, 277, 278, 279, 280, 281, 282, 67, 130, 270

[56] References Cited

U.S. PATENT DOCUMENTS

| | | | |
|---|---|---|---|
| 235,062 | 12/1880 | Baker | 297/247 X |
| 501,005 | 7/1893 | Goldsmith | 297/245 X |
| 539,723 | 5/1895 | Caisse | 272/88 |
| 565,165 | 8/1896 | Hall | 272/92 |
| 657,111 | 9/1900 | Hayes | 272/85 |
| 682,234 | 9/1901 | Bremser et al. | 297/247 X |
| 715,668 | 12/1902 | Kiddie | 297/245 X |
| 995,983 | 6/1911 | Murray | 297/278 |
| 1,462,796 | 7/1923 | Martin | 297/244 |
| 1,538,396 | 5/1925 | Garrett | 272/92 |
| 1,659,223 | 2/1928 | Swanson | 272/85 |
| 2,225,723 | 12/1940 | Spitzwieser | 297/247 X |
| 2,327,286 | 8/1943 | Oslick | 272/89 |
| 3,825,299 | 7/1974 | Gaucher | 297/273 X |
| 4,351,524 | 9/1982 | Gomes | 272/85 |

FOREIGN PATENT DOCUMENTS

| | | | |
|---|---|---|---|
| 1016338 | 1/1966 | United Kingdom | 272/87 |

*Primary Examiner*—Richard J. Johnson

[57] ABSTRACT

A garden swing of the type popular from 1890 is unstable when entering and leaving. This could result in accidents, especially for elderly people.

A novel, easily operated swing stabilizer device has been provided by this invention. Also the invention provides a tabletop that moves only horizontally when swinging. The tabletop provides a means for accommodating books, foods and drinks while relaxing and swinging.

3 Claims, 5 Drawing Figures

MODIFIED GARDEN SWING WITH STABILIZER

BACKGROUND OF THE INVENTION

1. Field of Invention

The two or four passenger garden swing was very popular from 1880 to 1915 but with the coming of radio and later, television, its popularity waned. Today, with the competition for 'quiet time' so keen, the garden swing is gaining in popularity again.

As times have changed, so have habits of gentle people changed. To ease their tired minds from the rigors of business, driving, and the ever fast moving pace of life, people need the carefree relaxation that the garden swing provides. This invention relates to the modernization of the garden swing to make it safer to enter and leave the swing and to provide a table for maximal enjoyment.

2. Description of Prior Art

Up until now there have been two features lacking in the garden swing of the general type shown herein: (1) a device for making it safe during entering and leaving the swing; and (2) a suitable means for supporting objects such as food, drinks, books, etc. during swinging. Presently available swings do not provide these features.

3. Disclosure Statement

My invention provides a unique table that is pivotably mounted between the two swinging chairs that face each other on a garden swing. This table swings with the chairs but its surface is always horizontal. Because of this fact, it is suitable for supporting glasses filled with drinks, food, and books needed for recreation. In addition, my invention provides for opposing struts which are each pivotably mounted at one end. They can be rotated downwardly to contact the entering platform. In so doing they act as stabilizers and prevent the swing from swinging. This is a big help to older and handicapped people to safely enter or leave the swing.

I do not know of any garden swing that provides either a means to stabilize the swing platform for safe entering and leaving the swing, or a swing table that is suitable to support food and drinks and moves horizontally during swinging. I have provided both features in a simple system by my invention.

SUMMARY OF THE INVENTION

This invention relates to a self-contained means by which the garden swing platform is stabilized against a swinging motion during entering and exiting the swing. This stabilizer is foldable and is out of sight when not in use.

My invention also provides a table having a horizontal motion during swinging. This table is suitable to hold books, a radio, t.v., food solids and tableware filled with liquids that do not spill during swinging. These features add to the enjoyment and relaxing on this modernized swing.

OBJECT OF THE INVENTION

An object of this invention is to provide a stabilizing means, operable before entering the swing, which, when engaged, will hold the platform steady and prevent the normal swinging motion, thus allowing safe entering of the swing.

Another object of this invention is to provide a means for storing the foregoing stabilizer out of sight but readily available for use on demand, without the operator having to leave his swing seat.

Another object of this invention is to provide a stabilizer that is easily operated by the person in the swing, to stabilize the platform to facilitate safe exit from the swing.

Still another object of this invention is to provide an accessible table, the movement of which is always horizontal when the swing is in swinging motion.

Other objects, features and advantages of this invention will be readily apparent from the following detailed description taken in connection with the accompanying drawings.

DESCRIPTION OF PREFERRED EMBODIMENT

Before explaining the present invention in detail it is to be understood that the invention is not limited in its application to the details of construction and arrangement of parts, illustrated in the accompanying drawing, since the invention is capable of other emobdiments and of being practiced or carried out in various ways. Also, it is to be understood that the phraseology or terminology employed herein is for the purpose of description and not of limitation.

Figure 1:
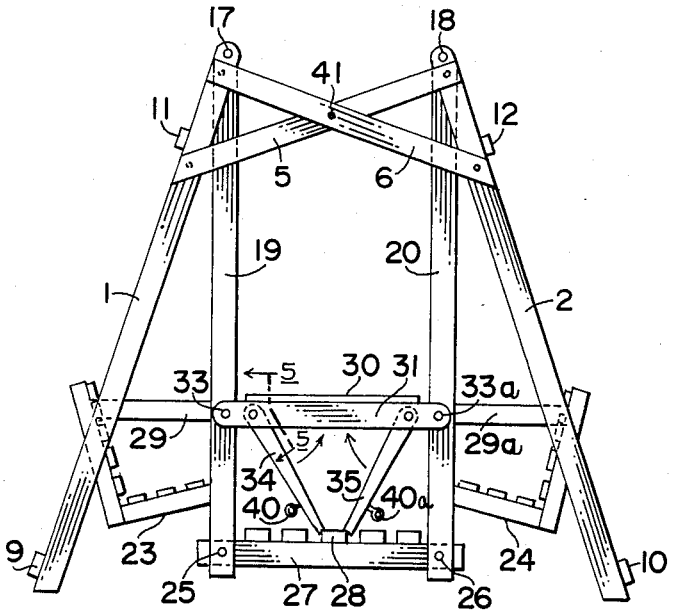
FIG. 1 is a side view of a garden swing with the stabilizer struts in the "down" position and engaged with the platform to prevent swinging of the swing chairs and platform assembly.
Figure 2:
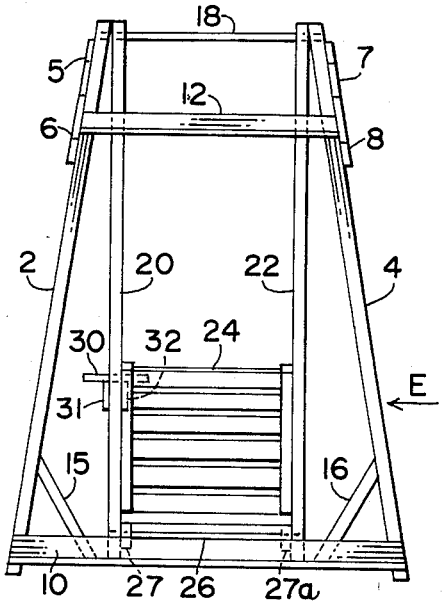
FIG. 2 is an end view of the garden swing.

FIG. 1 is a side view of a garden swing in which 1 and 2 are the main frame corner posts on the near side.

Figure 3:
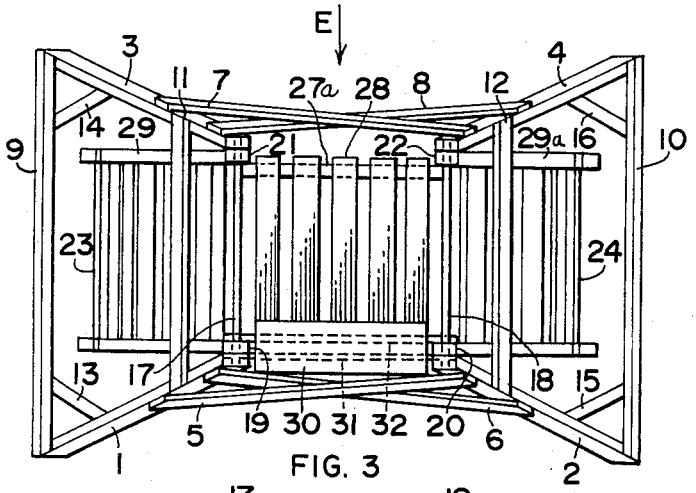
FIG. 3 is a top view of the swing showing the swing table.

FIG. 3 shows similar members 3 and 4 on the opposite side of the swing. These main corner posts are held rigidly in place by two sets of diagonal braces 5–6 and 7–8 respectively. Cross members 9 and 10 and 11 and 12 position the main frame corner posts on the swing side and sway-braces 13–14 and 15–16 keep the main frame structure rigid.

Figure 4:
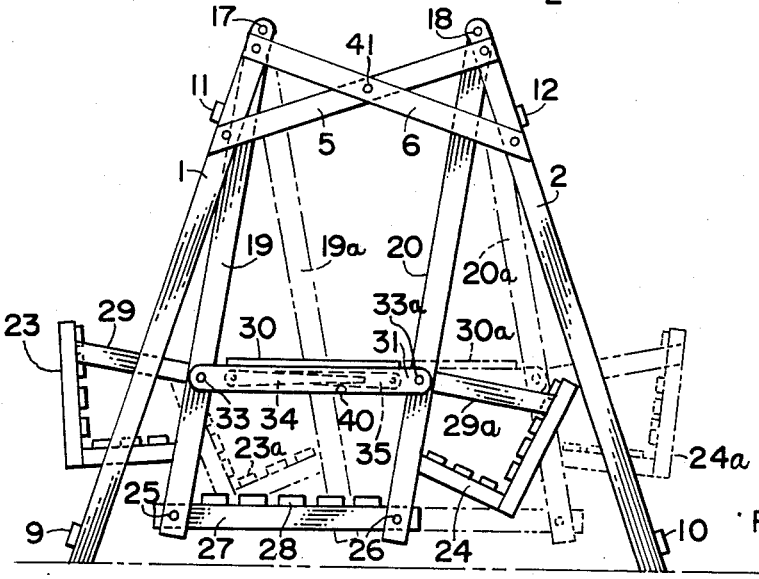
FIG. 4 is a side view of the garden swing with the chairs and platform swung to the left and a phantom view with the same elements swung to the right showing that the swing table is always horizontal when swinging.

Two ½" steel axle pipes 17 and 18 run between corner posts 1–3 and 2–4 respectively to support and serve as axles to the two pairs of vertical swing hanger members 19–20 and 21–22 which are mounted on pipes 17 and 18 so as to allow freedom of swinging motion as shown as in FIG. 4.

Two swing-seats 23 and 24 with their arm rests 29 and **29*a* accommodate the passenger or passengers. At the base of the two pairs of vertical hangers 19–21 and 20–22 and running between each pair of hangers are ½" iron pipes 25 and 26. Pivotably mounted on these axle pipes 25 and 26 are two stringers 27 and 27*a* which form the base of a platform built up of a plurality of cross members 28. The distance between axle pipes 17 and 18 is identical to the distance between pipes 25 and 26 so that when swinging as shown in FIG. 4, hanger members 19–20 and hanger members 21–22 are always parallel and the platform built on stringer 27 and 27*a***, is always horizontal. The preceding was a description of a conventional garden swing.

My invention relates to a swing-table and stabilizer system for installation on a standard garden swing described above. In the preferred embodiment of my invention are two horizontal cross members 31 and 32 which parallel each other and serve as a pair of supports for the tabletop. They are pivotably attached at their ends to the vertical hangers 19 and 20 by pivot bolts 33 and 33*a*. The pivot points are equidistant from pipes 25 and 26 respectively. Mounted on the top of the two horizontal members 31 and 32 is a tabletop 30. Its size is optional. Its height above the platform is also optional. When swinging, this tabletop 30 moves back and forth and always remains in a horizontal position and parallel to the floor platform support 27.

FIG. 4 shows the swing chairs 23 and 24, tabletop 30 and platform 27 deflected to the left. The phantom chairs 23*a* and 24*a*, the tabletop 30*a* and phantom platform 27*a* are shown deflected to the right. Note that although the angle of tilt of the chairs 23 and 24 vary during swinging, the tabletop 30 and phantom top 30*a* always remain horitzontal during swinging.

A second feature of my invention relates to a method of stabilizing the platform 28*a, b, c* against swinging which is an aid to users when entering and leaving the swing at location E. Without the action of the stabilizer system the swing is unsteady and is hazardous to users when entering or leaving the swing. To stabilize the platform 27, my invention provided two struts 34 and 35 that are pivotably mounted between horizontal cross members 31 and 32. FIG. 1 shows these two struts 34 and 35 rotated downward and in engagement with the platform cross members 28*a, b, c* forming two rigid triangles with members 27–19 and 27–20 respectively. Hence any swinging action of the swing platform 28*a, b, c* is prevented. When not in use during swinging, the two struts 34 and 35 are folded into the horizontal position and out of sight as shown in FIG. 4. They are held horizontally by friction.

Figure 5:
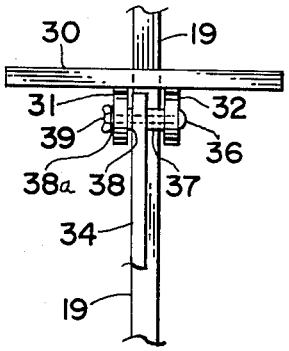
FIG. 5 is section 5—5 of FIG. 1 taken through the table assembly showing one stabilizer strut in the down position.

FIG. 5 is an enlarged detail of the section 5—5 of FIG. 1 showing one strut 34 in the down position. Note the location of spacer 37 and washers 38 and 38*a*. Tightening the wing-nut 39 builds up the friction against rotating and thus keeps strut 34 locked in a horizontal position when not is use. Two eyescrews 40 and 40*a*, one in each strut, serve as knobs to aid in retrieving the struts from "the storage position" and placing them in action as shown in FIG. 1.

I claim as my invention:

1. A swing consisting basically of a rigid frame for supporting a swinging mass, said mass formed by two sets of vertical hangers, the distance between members of each set of vertical hangers are equa-distance, and like members of each set are equa-distance from each other at their upper extremities at which locations they are pivotably mounted on said rigid frame, and the lower extremity of each of said hangers are pivotably mounted on a horizontal platform so all four hangers are parallel even when displaced by swinging of the mass; mounted on each set of vertical hangers is a chair facing each other, and on one side of each set of hangers on the same side of the swing is a cross member located approximately at chair height, pivotably mounted at both ends of said cross member and connected to one vertical hanger of each set on the same side of the swing to form a parallelogram consisting of one hanger from both sets on the same side of the swing, the said platform and said cross member; pivotably connected to said cross member is a strut that when folded downward in contact with said platform, said strut prevents said mass from swinging.

2. A swing consisting basically of a rigid frame for supporting a swinging mass, said mass formed by two sets of vertical hangers, the distance between members of each set of vertical hangers are equa-distance, and like members of each set are equa-distance from each other at their upper extremities at which locations they are pivotably mounted on said rigid frame, and the lower extremity of each of said hangers are pivotably mounted on a horizontal platform so all four hangers are parallel even when displaced by swinging of the mass; mounted on each set of vertical hangers is a chair facing each other, and on one side of each set of hangers on the same side of the swing is a cross member located approximately at chair height, pivotably mounted at both ends of said cross member and connected to one vertical hanger of each set on the same side of the swing to form a parallelogram consisting of one hanger from both sets on the same side of the swing, the said platform and said cross member; a table top mounted on said cross member located to be useable conveniently by occupants of either of said chairs.

3. A swing consisting basically of a rigid frame for supporting a swinging mass, said mass formed by two sets of vertical hangers, the distance between members of each set of vertical hangers are equa-distance, and like members of each set are equa-distance from each other at their upper extremities at which locations they are pivotably mounted on said rigid frame, and the lower extremity of each of said hangers are pivotably mounted on a horizontal platform so all four hangers are parallel even when displaced by swinging of the mass; mounted on each set of vertical hangers is a chair facing each other, and on one side of each set of hangers on the same side of the swing is a cross member located approximately at chair height, pivotably mounted at both ends of said cross member and connected to one vertical hanger of each set on the same side of the swing to form a parallelogram consisting of one hanger from both sets on the same side of the swing, the said platform and said cross member; pivotably connected to said cross member is a strut that when folded downward in contact with said platform, said strut prevents said mass from swinging; a table top mounted on said cross member located to be useable conveniently by occupants of either of said chairs.

* * * * *